US005354492A

United States Patent [19]

Short

[11] Patent Number: 5,354,492

[45] Date of Patent: Oct. 11, 1994

[54] AQUEOUS CLEANING SOLUTIONS FOR REMOVING UNCURED URETHANE RESIN SYSTEMS FROM THE SURFACES OF PROCESSING EQUIPMENT

[75] Inventor: Sidney M. Short, Fredonia, Wis.

[73] Assignee: Cook Composites and Polymers Company, Port Washington, Wis.

[21] Appl. No.: 940,677

[22] Filed: Sep. 4, 1992

[51] Int. Cl.[5] ..... C11D 7/22

[52] U.S. Cl. ..... 252/162; 252/153; 252/170; 252/171; 252/174.21; 252/DIG. 8

[58] Field of Search ..... 252/162, 170, 171, 542, 252/153, DIG. 8, 174.21

[56] References Cited

U.S. PATENT DOCUMENTS

| | | | |
|---|---|---|---|
| 4,325,513 | 4/1982 | Smith et al. | 239/112 |
| 4,583,691 | 4/1986 | Smith | 239/112 |
| 4,780,235 | 10/1988 | Jackson | 252/170 |
| 4,934,391 | 6/1990 | Futch et al. | 252/174.21 |
| 5,006,279 | 4/1991 | Grobbel et al. | 252/166 |
| 5,015,410 | 5/1991 | Sullivan | 252/166 |
| 5,035,829 | 7/1991 | Suwala | 252/170 |
| 5,049,314 | 9/1991 | Short | 252/542 |
| 5,062,988 | 11/1991 | Dishart et al. | 252/170 |
| 5,064,557 | 11/1991 | Fusiak | 252/162 |
| 5,073,287 | 12/1991 | Harelstad | 252/153 |
| 5,084,200 | 1/1992 | Dishart et al. | 252/173 |
| 5,085,795 | 4/1992 | Narayanan et al. | 252/162 |
| 5,089,164 | 2/1992 | Stanley | 252/162 |
| 5,098,592 | 3/1992 | Narayanan et al. | 252/162 |
| 5,098,594 | 3/1992 | Doscher | 252/162 |
| 5,124,062 | 6/1992 | Stevens | 252/DIG. 8 |

*Primary Examiner*—Paul Lieberman
*Assistant Examiner*—Necholus Ogden
*Attorney, Agent, or Firm*—Whyte, Hirschboeck Dudek

[57] ABSTRACT

Uncured polyurethane resin systems are efficiently removed from the surfaces of dispensing equipment, tools and other such items on which the resin systems are not desired by a cleaning solution comprising:

1. water;
2. at least about 2 wt % of at least one dibasic ester; and
3. a catalytic amount of a catalyst for promoting a reaction between the isocyanate and the water.

Preferably, the cleaning solution contains a solubilizing amount of a cosolvent and/or surfactant capable of coupling with the dibasic ester.

8 Claims, No Drawings

AQUEOUS CLEANING SOLUTIONS FOR REMOVING UNCURED URETHANE RESIN SYSTEMS FROM THE SURFACES OF PROCESSING EQUIPMENT

BACKGROUND OF THE INVENTION

This invention relates to cleaning solutions. In one aspect, this invention relates to cleaning solutions for removing uncured polyurethane resin systems from surfaces of processing equipment or any other surface on which it is undesired, while in another aspect, this invention relates to cleaning solutions comprising one or more dibasic esters, water and a catalyst useful for promoting a reaction between water and an isocyanate. In yet another aspect, this invention relates to aqueous cleaning solutions comprising at least one dibasic ester, water, a catalyst and a cosolvent and/or surfactant capable of coupling with the dibasic ester and water. In still another aspect, this invention relates to using the cleaning solutions as a cleansing flush for polyurethane foam processing equipment.

Many, if not most, polyurethane resin systems are two-part systems comprising a liquid isocyanate and a liquid polyol. In the manufacture of materials from these systems, typically each component is metered and pumped separately to a mixing head in which they are blended and either simultaneously or subsequently discharged or "shot" onto a surface or injected into a mold. The mixed isocyanate and polyol react quickly with one another, even in the absence of a catalyst, and as such, the blend quickly begins to gel or solidify. Because these systems gel or solidify quickly, and because a residual amount often remains within the processing equipment after use, e.g. within the mixing head after discharge or injection, the equipment head often requires cleansing or flushing after each use.

Preferred cleaning solutions exhibit good cleaning efficiency, low health hazard, low flammability hazard, ease of reclamation and/or disposal, and environmental safety. Traditional cleaning solutions contain a large portion of methylene chloride, an effective cleansing agent with many desirable characteristics, but one that is coming under increasing government regulation for both health and environmental reasons. Of the commercially available alternatives, those cleaning solutions based on mixtures of dibasic esters, generally known as "DBE", are preferred because not only do they possess desirable human and environmental safety characteristics, but they also possess a relatively good cleaning efficiency and a low flammability hazard. However, these DBE-based cleaning solutions also exhibit an undesirable low-loading characteristic, i.e. they gel after a period of time during which the isocyanate-polyol reaction completes polymerization. As such, recycling or disposing of used cleaning solution is both difficult and expensive.

SUMMARY OF THE INVENTION

According to this invention, uncured polyurethane resin systems are efficiently removed from the surfaces of dispensing equipment, tools and other such items on which the systems are not desired by a cleaning solution comprising, based on the weight of the solution:

1. water;
2. at least about 2 percent of at least one dibasic ester; and 3. a catalytic amount of a catalyst for promoting a reaction between the isocyanate and the water.

Preferably, the cleaning solution contains a solubilizing amount of a cosolvent and/or surfactant capable of coupling with the dibasic ester. As here used, "coupling" means the physical or chemical joining of the cosolvent and/or surfactant with the dibasic ester, such that the solubility of the dibasic ester in water is increased. One of the advantages of using the cleaning solutions of this invention is that they produce a solid urethane phase which may be easily separated from the aqueous phase and discarded. In some embodiments, the aqueous phase can be recycled. Other advantages include a low product cost, low disposal costs, and a relatively low impact on human health and the environment.

DESCRIPTION OF THE PREFERRED EMBODIMENTS

Any dibasic ester or mixture of such esters that will remove an uncured polyurethane resin system from the surface of dispensing equipment or other similar items can be used in the practice of this invention. Unless otherwise required by the text of this specification, "dibasic ester" includes both a single dibasic ester and a mixture of dibasic esters. Preferred dibasic esters are of the formula $$R_1OOC—R—COOR_1$$

wherein:

R is an alkylene, or an inertly-substituted alkylene radical of 1 to about 12 carbon atoms, and each $R_1$ is independently an alkyl or an inertly-substituted alkyl radical of 1 to about 6 carbon atoms.

Preferably R is of 2 to about 6 carbon atoms, and each $R_1$ is 1 or 2 carbon atoms. "Independently" means that each $R_1$ can be the same or different, e.g. each $R_1$ can be a methyl radical or one $R_1$ can be a methyl radical while the other is an ethyl radical. "Inertly-substituted" means that the radical can bear one or more substituents that are essentially nonreactive toward the process reagents and products at the process conditions. Typical inert substituents include alkyl radicals of 1 or 2 carbon atoms.

Although the dibasic esters can be used either alone or in combination with one or more other dibasic esters, mixtures are usually favored for reasons of cost and general availability. The particular components of the mixture and their amounts relative to one another can vary widely. Mixtures commercially known as DBE which are comprised of dimethyl glutarate, dimethyl adipate and dimethyl succinate, perform well in this invention.

The water used in the practice of this invention reacts with the isocyanate component of the polyurethane resin system. This requires the reaction product of the isocyanate and the water to be essentially nonreactive with the other materials present, e.g. the polyol, the catalyst or other additives (e.g. surfactant) and unreacted alcohol (polyol). The aqueous formulations of this invention are particularly advantageous over non-aqueous formulations because their biodegradability obviates or reduces concern about health and pollution.

Any catalyst that will promote the chain-stopping reaction between the isocyanate component of the polyurethane resin system and water at the conditions at which the uncured resin system is removed from resin handling equipment can also be used in the practice of this invention. Typical of these catalysts are the primary, secondary and tertiary amines. The tertiary amines are non-sacrificial in that they are not consumed in the reaction, and include the tertiary alkyl, aryl or aralkyl amines, the N-alkyl substituted five-membered ring lactams, or the N-alkyl substituted six-membered morpholine rings.

The primary and secondary amines are sacrificial catalysts in that they are consumed in the reaction, i.e. they react and bond with the isocyanate. The primary and secondary amine catalysts include the primary and secondary alkyl, aryl or aralkyl amines, five-membered ring lactams, or six-membered morpholine rings. The primary and secondary amine catalysts are as desirable as their tertiary relatives.

Representative preferred tertiary amines include the trialkylamines such as triethylamine, tributylamine, etc., and dimethylaminoethanol, tetramethylbutane diamine, dimethyl cyclohexylamine, dimethylhexadecyl amine, and the like. Representative five-membered ring lactams include the hydrocarbon 2-pyrrolidones. Representative six-membered morpholine rings include the N-alkylmorpholines. N-methyl-2-pyrrolidone (NMP) is a preferred catalyst of this invention.

Optionally, a surfactant or combination of surfactants can also be used in the practice of this invention. Use of a surfactant provides the additional advantage of using an increased concentration of one or more dibasic esters in the aqueous solution. Generally, the greater the concentration of dibasic ester in aqueous solution, the greater the cleaning effectiveness of the formula. Any surfactant that will increase the solubility of the dibasic ester in water can also be used in the practice of this invention.

Typical surfactants include ethoxylated alkyl phenols, polyethoxylated alcohols, linear aliphatic ethoxylates, polyethoxylated castor oil, polyethoxylated carboxylates and polyethoxylated alkylamines. Additional surfactants include fluorinated surfactants such as perfluoroalkylethoxylates, and silicone surfactants such as alkenyloxy siloxanes. Anionic surfactants may also be used and include phosphate esters and their salts, alkyl sulfates and sulfonates, salts of sulfated nonylphenoxypoly(ethoxy)ethanol, salts of alkylbenzene sulfonates, salts of alkyl-naphthalene sulfonates, and sulfonated aliphatic polyesters and their salts. Also suitable are complex phosphate esters of nonionic surfactants of the ethylene oxide type which are mixtures of diesters of phosphoric acid and fluorinated surfactants such as mono and bis perfluoro-alkyl phosphates and salts, fluoroalkyl sulfates, and sulfonates. Cationic surfactants which may be used include quaternized perfluoroalkylamines and the like. These and other suitable surfactants are more fully described in McCutcheon's *Emulsifiers and Detergents* (1989), published by McCutcheon's Division of M.C. Publishing Co., Glen Rock, N.J.

Octylphenol ethoxylate is a preferred surfactant because of both its ability to increase the solubility of the dibasic ester and NMP in water, and its relatively inexpensive price. Surfactants with a greater affinity to solubilize dibasic ester in water would be even more preferred, because the more dibasic ester present, the greater the cleaning ability.

As noted above, the cleaning formula is preferably an aqueous solution containing at least about 60 weight percent water, at least 1 weight percent of at least one dibasic ester, at least a catalytic amount of a catalyst that will promote the reaction between water and an isocyanate, and optionally at least a solubilizing amount of a surfactant that will increase the solubility of dibasic ester in water. Typically, based on the weight of the cleaning solution, the concentration of water present is in the range of 60 to 98 weight percent. Preferably, the concentration of water is between 70 and 95 weight percent. Most preferably, in a commercial preparation, the concentration of water is between 77 and 90 weight percent. The primary consideration for the use of water in the formulation of the invention is to reduce the cost of manufacture.

Typically, the concentration of catalyst is between 1 to 25 weight percent. Preferably, the concentration of catalyst is between 2 and 20 weight percent. Most preferably, in a commercial preparation, catalyst is present between 4 and 15 weight percent. The limitations on the maximum amount of catalyst are the compatibility; e.g., reactivity, solubility, etc. with water; expense; the minimum concentrations of the other components of the cleaning solution; availability; and convenience.

Typically, the concentration of dibasic ester or dibasic ester mixture is between 1 and 12 weight percent. Preferably, the concentration of dibasic ester is between 2 and 12 weight percent. Most preferably, in a commercial preparation, the concentration of dibasic ester is between 4 and 8 weight percent. The primary limitation on the maximum amount is the ability to get the compounds to form a solution with water. Use of a surfactant increases the solubility of dibasic esters in water, and hence, the cleaning efficiency of the solution. The limit on the lower concentration of dibasic ester is the cleaning efficacy.

When present, the concentration of the surfactant is usually at least about 1 wt %, preferably at least about 2 wt %, and most preferably at least about 3 wt %, based on the total weight of the cleaning solution. Practical considerations, such a economy and convenience, are the only limitations on the maximum amount of surfactant that can be used. One practical consideration is the tendency of the cleaning solution to leave a film on the surface to be cleaned if too much surfactant is used. The typical maximum amount is 10 wt %, preferably 8 wt %, and most preferably 6 wt %, again based on the total weight of the cleaning solution.

The cleaning solutions of this invention can contain other components as well, such as dyes, fragrances, and the like.

The cleaning solutions of this invention are used in the same manner as other known cleaning solutions. After the uncured polyurethane resin system is discharged from a piece of dispensing equipment, or after it comes in contact with a surface, typically a metal surface, on which it is not wanted, then the cleaning solution is applied to the dispensing equipment or surface in a manner and in a quantity that solyates the resin system into the solution for subsequent removal. In the case of polyurethane foam guns, each shot of uncured resin system is followed by a like shot of cleaning solution. In those cases in which an uncured resin system is to be removed from a surface other than an internal surface of a mixing head or other piece of discharge or injection equipment, the cleaning solution can be applied to the uncured resin system in any convenient manner, e.g. spraying, brushing, dipping, etc., and then removed in any convenient manner, e.g. flushing, wiping, etc. The cleaning solutions can be used under any conditions. Under typical use conditions, embodiments of the cleaning solution of this invention are non-flammable. These embodiments of the invention are inflammable under OSHA, DOT and EPA standards. These embodiments are also considered unignitable under EPA standards. Typical organic solvent based cleaning systems are flammable by nature. At elevated temperatures dangerously close to the flash point of typical organic solvent based cleaning solutions, the preferred embodiments of the present invention may be used with little risk of ignition. Since the resin systems are usually designed for relatively rapid cure, the cleaning solution preferably is applied to the equipment to be cleaned as soon as possible after urethane resin system has been in contact with the application equipment.

Any of the known polyurethane resin systems in use today can be removed, in their uncured state, from a metal surface, typically a stainless steel surface, by the cleaning solutions of this invention. These systems are typically two-part systems containing at least one polyol and at least one isocyanate that will react with one another, either in the presence or absence of a catalyst, to form a polyurethane. As here used, "uncured" includes systems that are partially cured, i.e. systems in which only a portion of the polyol and isocyanate have reacted to form a polyurethane. The greater the extent of this partial curing, the less efficient the cleaning solution in removing the resin system from a surface.

The cleaning solutions of this invention leave both a solid urethane phase and an aqueous phase, both uncontaminated with hazardous materials such as methylene chloride, and which can be easily and economically disposed. The solid phase can be disposed with other solid urethane scrap while, under some circumstances, the aqueous phase may be disposed, pending appropriate testing, into a typical municipal water treatment facility. In other circumstances, the aqueous phase can be recycled depending, at least in part, upon the amount of components consumed. Under laboratory conditions, it was noticed that a small amount of surfactant and NMP was consumed via reaction with the urethane. Dibasic ester and NMP were also present in the urethane phase. The aqueous nature of this invention gives rise to a low product cost, low disposal cost because of the lack of hazardous contaminates, and low risk of damage to human health and the environment.

The following examples are illustrative of certain specific embodiments of this invention. Unless indicated to the contrary, all parts and percentages are by weight.

SPECIFIC EMBODIMENTS

Except where otherwise noted the urethane system used in the cleaning and gelling tests is a commercial, water blown, Coast Guard approved, flotation foam.

Sample Preparation and Test Procedure a) Into a paper cup with 50 grams of the polyol portion is placed 1.5 grams of a black, compatible pigment. Isocyanate (85 grams) is then added, and the compounds are mixed for 25 seconds at 1400 rpm with a 2 inch propeller.

b) The excess mix is spun off the mixer by removing the mixer from the mixture and operated at 1400 rpm for 10 seconds.

c) The foam mix is then immediately discarded.

d) The remaining foam mix on the propeller is hosed off with the test solution applied from a 500 ml Nalgene® wash bottle which is kept over half-full at all times.

e) The time and the amount of cleaning solution required to clean the propeller is then recorded. The propeller is tested for cleanliness by wiping with a clean tissue. Test results indicated failure if blackness appeared on the tissue, but a little grayness is acceptable. The above protocol was repeated five times for each test solution, and the average is reported in Table 1 below. Table 2 reports the field trial results of three solutions other than those used in the laboratory test.

TABLE 1

CLEANING EFFICIENCY TEST RESULTS AND OBSERVATIONS

| Ex./ | Cleaning Sol'n Comp. | | | | Cleaning Effectiveness | | |
|---|---|---|---|---|---|---|---|
| Control | $H_2O$ | DBE | NMP | OPE | Time (sec.) | Amt. (ml.) | Comment |
| 1 | 77 | 8.0 | 12.0 | 3.0 | 95 | 110 | P |
| C-1 | — | 100 | — | — | 77 | 78 | P |
| C-2 | — | 80 | 20 | — | 83 | 83 | P |
| 2 | 73 | — | 24 | 3.0 | >180 | >187 | F |
| 3 | 90 | 4.0 | 4.0 | 2.0 | 121 | 137 | P[1] |

KEY
$H_2O$ = Water
DBE = Dibasic ester or dibasic ester mixture
NMP = N-Methyl-2-pyrrolidone
OPE = Octylphenol ethoxylate
P = Formula was an effective cleansing agent.
F = Formula did not appreciably cleanse the propeller of urethane system. Necessitated use of efficacious cleansing agent such as pure DBE.
P[1] = Formula tested by an experienced technician and judged to be an effective cleaner.

TABLE 2

CLEANING EFFECTIVENESS TEST RESULTS OF FIELD TRIALS

| | Cleaning Sol'n Comp. | | | | | Cleaning Effectiveness |
|---|---|---|---|---|---|---|
| Ex. | $H_2O$ | DBE | NMP | OPE | PC | Comment |
| 4* | 80 | 5.0 | 5.0 | 3.0 | 7.0 | 1 |
| 5* | 90 | 2.5 | 2.5 | 1.5 | 3.5 | 2 |
| 6* | 73 | 9.0 | 15.0 | 3.0 | — | 3 |

KEY
$H_2O$ = Water
DBE = Dibasic ester or dibasic ester mixture
NMP = N-Methyl-2-pyrroldione
OPE = Octylphenol ethoxylate
PC = Propylene carbonate
*These formulas were not tested by the lab tests, and a quantitative comparison to Examples 1–3 is not available.
1 Formula tested by an experienced technician and judged to be an effective cleaner.
2 Formula tested by an experienced technician and judged to be a non-effective cleaning agent.
3 Formula did not remain as a stable solution and was not tested for efficacy.

Discussion of Experimental Results

Example 1 shows a synergistic effect between the ingredients, since the cleaning efficiency of dibasic ester and NMP together is greater than each alone. Also, as the dibasic ester is present in concentration substantially above its normal solubility in water, the NMP and OPE are likely acting as coupling agents.

Example 2 failed to clean the propeller mixer at all. The NMP and OPE could not be replaced with dibasic ester because 27 wt % dibasic ester is substantially above the solubility of dibasic ester in water. This level of dibasic ester in aqueous solution necessitates the use of a much more efficient surfactant than OPE.

Example 3 indicates that as the amount of dibasic ester and NMP in solution is decreased while the amount of water in solution is increased, the cleaning efficiency of the formula decreases.

Examples 4 and 5 demonstrate that only dibasic ester and NMP are contributing to the cleaning ability of the formula.

Example 6 demonstrates the existence of an upper limit for the concentration of dibasic ester present in the solution. When the concentration of dibasic ester and NMP were changed from 8.0% and 12.0% (Example 1), respectively to 9.0% and 15% (Example 6), respectively, with the concentration of octylphenol ethoxylate remaining constant (3%), the formula began to separate. There was no observed separation when the proportions of the two ingredients (DBE & NMP) were at lower, but equivalent concentrations (Examples 3,4,5).

The above examples and experiments suggest the following purpose for each of the ingredients. Water is an inexpensive solvent-vehicle which allows for the easy separation of the polyurethane as a solid. NMP is not only a catalyst for the reaction of isocyanates with water, but it also couples the dibasic ester with water. OPE is the surfactant which promotes cleaning and, probably, also couples the dibasic ester with water. Dibasic ester is the principle cleaner, as the cleaning efficiency of the formula increases with the amount of dibasic ester in aqueous solution.

Although this invention has been described in considerable detail through the preceding examples, this detail is for the purpose of illustration only. Many variations and modifications can be made by one skilled in the art without departing from the spirit and scope of the invention.

I claim:

1. An aqueous cleaning solution for removing an uncured polyurethane resin system comprising an isocyanate and a polyol from a surface, the aqueous solution consisting of, based on the weight of the solution, between about:

A. 60 and about 98 wt % water;

B. 1 and 12 wt % of at least one dibasic ester; is of the formula:

$$R_1COO—R—COOR_1$$

wherein: R is an alkylene or an inertly-substituted alkylene radical of 1 to about 12 carbon atoms, and each $R_1$ is independently an alkyl or an inertly-substituted alkyl radical of 1 to 6 carbon atoms.

C. a catalytic amount and about 25 wt % of a catalyst comprising at least one of a primary, secondary or tertiary amine, a five-membered ring lactam, and a six-membered, primary, secondary or tertiary morpholine ring for promoting a reaction between the isocyanate and water; and D. 1 and 10 wt % of a surfactant comprising at least one of ethoxylated alkyl phenols, polyethoxylated alcohols and linear aliphatic ethoxylates.

2. The cleaning solution of claim 1 wherein the dibasic ester is a mixture of dibasic esters.

3. The cleaning solution of claim 2 in which the mixture of dibasic esters comprises dimethyl glutarate, dimethyl adipate and dimethyl succinate.

4. The cleaning solution of claim 3 in which the catalyst is a five membered ring lactam.

5. The cleaning solution of claim 4 in which the catalyst is N-methyl-2-pyrrolidone.

6. The cleaning solution of claim 5 in which the surfactant is octylphenol ethoxylate.

7. A method of cleaning a polyurethane applicator system incorporating the cleaning solution of claim 1 from a surface.

8. A method of cleaning a polyurethane applicator system incorporating the cleaning solution of claim 6 from a surface.

* * * * *